US010397728B2

(12) United States Patent
Kärkkäinen et al.

(10) Patent No.: US 10,397,728 B2
(45) Date of Patent: Aug. 27, 2019

(54) DIFFERENTIAL HEADTRACKING APPARATUS

(71) Applicant: NOKIA TECHNOLOGIES OY, Espoo (FI)

(72) Inventors: Leo Kärkkäinen, Helsinki (FI); Asta Kärkkäinen, Helsinki (FI); Jussi Virolainen, Espoo (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/762,740

(22) PCT Filed: Sep. 26, 2016

(86) PCT No.: PCT/FI2016/050668
§ 371 (c)(1),
(2) Date: Mar. 23, 2018

(87) PCT Pub. No.: WO2017/051079
PCT Pub. Date: Mar. 30, 2017

(65) Prior Publication Data

US 2018/0220253 A1 Aug. 2, 2018

(30) Foreign Application Priority Data

Sep. 25, 2015 (GB) ..... 1517013.7

(51) Int. Cl.
*H04R 1/10* (2006.01)
*H04S 7/00* (2006.01)
*H04R 5/033* (2006.01)

(52) U.S. Cl.
CPC ..... *H04S 7/304* (2013.01); *H04R 1/1041* (2013.01); *H04R 5/033* (2013.01); *H04S 7/303* (2013.01); *H04S 2400/01* (2013.01); *H04S 2400/11* (2013.01); *H04S 2420/01* (2013.01); *H04S 2420/03* (2013.01)

(58) Field of Classification Search
CPC ..... H04S 2400/11; H04S 7/30
USPC ..... 381/310, 17, 303
See application file for complete search history.

(56) References Cited

U.S. PATENT DOCUMENTS

| | | | | |
|---|---|---|---|---|
| 6,349,001 | B1 | 2/2002 | Spitzer | |
| 7,275,008 | B2 | 9/2007 | Plyvanainen | |
| 2002/0194914 | A1 | 12/2002 | Foxlin et al. | |
| 2008/0031462 | A1* | 2/2008 | Walsh | H04S 3/02 381/17 |
| 2011/0293129 | A1 | 12/2011 | Dillen et al. | |
| 2012/0046768 | A1* | 2/2012 | Raoufi | H04M 1/6058 700/94 |
| 2013/0208899 | A1 | 8/2013 | Vincent et al. | |

(Continued)

OTHER PUBLICATIONS

Blauert, J., "Spatial Hearing: The Psychophysics of Human Sound Localization", (rev. ed.),The MIT press (dated 1996).

(Continued)

*Primary Examiner* — Alexander Jamal
(74) *Attorney, Agent, or Firm* — Alston & Bird LLP

(57) ABSTRACT

Apparatus comprising a processor configured to: determine a first orientation value of a head (101) of a user (100) of the apparatus relative to a further body part (111) of the user (100) using at least one orientation sensor (105); and control a 3D audio reproduction function of the apparatus based on the first orientation value.

22 Claims, 10 Drawing Sheets

(56) References Cited

U.S. PATENT DOCUMENTS

2014/0153751 A1 6/2014 Wells
2016/0345095 A1* 11/2016 Gamper ..... H04R 5/0335

OTHER PUBLICATIONS

International Search Report and Written Opinion for Application No. PCT/2016/050668 dated Jan. 26, 2017, 14 pages.
Brinkmann, F. et al., *Processing of Head-Above-Torso Orientation in Head-Related Transfer Functions*, Tu Berlin, Audio Communication Group, White Paper 2014/01, 10 pages.
Foxlin, E., *Head-Tracking Relative to a Moving Vehicle or Simulator Platform Using Differential Inertial Sensors*, Proceedings of Helmet and Head-Mounted Displays V, SPIE vol. 4021, AeroSense Symposium (Apr. 2000), 12 pages.

* cited by examiner

DIFFERENTIAL HEADTRACKING APPARATUS

FIELD

The present application relates to apparatus for differential headtracking apparatus. The invention further relates to, but is not limited to, differential headtracking apparatus for spatial processing of audio signals to enable spatial reproduction of audio signals.

BACKGROUND

In normal headphone listening, when the listener rotates his head, the sound scene rotates accordingly. In a 3D audio context, headtracking defines the monitoring of an orientation of the listener's head. This orientation information may then be used to control spatial processing such as 3D audio rendering to compensate for head rotations. In employing head rotation compensation the sound scene presented to the listener can be made stable relative to the environment.

Stabilization of the sound scene produces several advantages. Firstly, by employing headtracking the perceived 3D audio quality of a spatialization system may be improved. Secondly, by employing headtracking new 3D audio solutions can be developed. For example virtual and augmented reality applications can employ headtracking.

3D audio processing is typically performed by applying head related transfer function (HRTF) filtering to produce binaural signals from a monophonic input signal. HRTF filtering creates artificial localization cues including interaural time difference (ITD) and frequency dependent interaural level difference (ILD) that auditory system uses to define a position of the sound event.

However, localization performance of a static (in other words head motion independent) 3D audio spatialization system has certain limitations. An auditory event is said to be localized to a so-called "cone of confusion" if the ILD value is the same for all positions, but the frequency dependent ILD varies. As the ITD cue in the cone is ambiguous, the listener will have difficulty in discriminating sounds based only on their spectral characteristics. As a result, front-back reversal is a common problem in 3D audio systems.

Head motion provides an important aid to help to localize sounds. By moving the head the ITD between the ears can be minimized (which can be considered to be equal to switching to the most accurate localization region). In all cases in which localization is anomalous or ambiguous, exploratory head movements take on great importance such as indicated in Blauert, J., "Spatial Hearing: The Psychophysics of Human Sound Localization", (rev. ed.), The MIT press, 1996.

Thus, headtracking gives the listener a possible way to use head motion to improve localization performance of the 3D audio system, and especially for front-back reversals.

Modern microelectromechanical system (MEMS) or piezoelectric accelerometers, gyroscopes and magnetometers are known to provide low cost and miniature components that can be used for orientation tracking. This tracking is based on absolute measurements of the direction of gravity and Earth's magnetic field relative to the device. Gyroscopes provide angular rate measurements which can be integrated to obtained accurate estimates of the changes in the orientation. The gyroscope is fast and accurate, but ultimately the integration error will always cumulate, so absolute measurements are required. Magnetometers, unfortunately, suffer from significant calibration issues, of which only some have been solved. In some augmented reality systems which contain a camera, the optical flow of the camera system can also be used for headtracking. In many occasions headtracking is performed by a fusion of many methods.

Spatial audio processing, where audio signals are processed based on directional information may be implemented within applications such as spatial sound reproduction. The aim of spatial sound reproduction is to reproduce the perception of spatial aspects of a sound field. These include the direction, the distance, and the size of the sound source, as well as properties of the surrounding physical space.

SUMMARY

There is provided according to a first aspect an apparatus comprising a processor configured to: determine a first orientation value of a head of a user of the apparatus relative to a further body part of the user using at least one orientation sensor; and control at least one function of the apparatus based on the first orientation value.

The processor configured to determine a first orientation value of a head of a user of the apparatus relative to a further body part of the user using at least one orientation sensor may be further configured to: determine a first absolute orientation value of a head of the user relative to a reference orientation using a head mounted orientation sensor; and determine a second absolute orientation value of the further body part of the user relative to a further reference value using a further body located sensor.

The processor configured to control at least one function of the apparatus based on the first orientation value may be further configured to control the at least one function based on the first absolute orientation value and the second absolute orientation value.

The processor configured to determine a first orientation value may be further configured to: determine a relationship between the reference orientation and the further reference orientation; and determine the first orientation value based on the first absolute orientation value and the second absolute orientation value.

The reference orientation may be the further reference orientation.

The head mounted orientation sensor may be located within at least one of the following: a headphone set; a headset; a head worn camera; and an earpiece.

The further body located sensor may be located within at least one of the following located on or worn by the user: a user equipment; a fitness band; a heart rate monitor; a smart watch; and a mobile or wearable device.

The at least one orientation sensor may be a differential orientation sensor configured to determine an orientation of the head of the user relative to the further body part directly.

The differential orientation sensor may comprise an optical differential sensor configured to determine an orientation of the head of the user relative to the body by detecting light reflected from the body.

The differential orientation sensor may comprise an acoustic differential sensor configured to determine an orientation of the head of the user relative to the body by detecting audio reflected from the body.

The differential orientation sensor may comprise a physical differential sensor configured to determine an orientation of the head of the user relative to the body by detecting tension within cables coupling the head of the user to the apparatus.

The processor may be a spatial audio processor configured to receive at least one audio signal, the at least one function of the apparatus may be a spatial processing of the at least one audio signal based on the first orientation value of the head of the user of the apparatus relative to the further body part of the user.

The processor may be configured to: determine at least one first filter from a database comprising a plurality of filters based on the first orientation value; and apply the at least one first filter to the at least one audio signal to generate a first output signal to generate at least one spatially processed audio signal.

The processor may be a spatial audio processor configured to receive at least one audio signal, the at least one function of the apparatus is a spatial processing of the at least one audio signal based on the first orientation value of the head of the user of the apparatus relative to the further body part of the user, and the processor may be configured to: determine at least one first filter based on a difference value defined by a difference between the first absolute orientation value and the second orientation value; apply the at least one first filter to the at least one audio signal to generate a first output signal associated with the orientation of the further body part of the user; determine at least one second filter based on the first absolute orientation value; apply the at least one second filter to the at least one audio signal to generate a second output signal associated with the orientation of the head of the user relative to a reference orientation; and combine the first output signal and second output signal to generate at least one spatially processed audio signal.

The processor configured to determine at least one first filter based on the difference value may be configured to determine the at least one first filter from a database comprising a plurality of filters based on the difference value.

The processor configured to determine at least one second filter based on the first absolute orientation value may be configured to determine the at least one second filter from a database comprising a plurality of filters based on the first absolute orientation value.

The at least one function of the apparatus may be a playback of an audio signal, and the processor may be further configured to control playback of the audio signal based on the first orientation value.

The at least one function of the apparatus may be determining a gesture for gesture control of the apparatus, and the processor may be further configured to determine a gesture based on the first orientation value.

According to a second aspect there is provided a method comprising: determining a first orientation value of a head of a user of the apparatus relative to a further body part of the user using at least one orientation sensor; and controlling at least one function of the apparatus based on the first orientation value.

Determining a first orientation value of a head of a user of the apparatus relative to a further body part of the user using at least one orientation sensor may comprise: determining a first absolute orientation value of a head of the user relative to a reference orientation using a head mounted orientation sensor; and determining a second absolute orientation value of the further body part of the user relative to a further reference value using a further body located sensor.

Controlling at least one function of the apparatus based on the first orientation value may further comprise controlling the at least one function based on the first absolute orientation value and the second absolute orientation value.

The method may comprise determining a relationship between the reference orientation and the further reference orientation; and determining the first orientation value based on the first absolute orientation value and the second absolute orientation value.

The reference orientation may be the further reference orientation.

The head mounted orientation sensor may be located within at least one of the following: a headphone set; a headset; a head worn camera; and an earpiece.

The further body located sensor may be located within at least one of the following located on or worn by the user: a user equipment; a fitness band; a heart rate monitor; a smart watch; and a mobile or wearable device.

The at least one orientation sensor may be a differential orientation sensor configured to determine an orientation of the head of the user relative to the further body part directly.

The differential orientation sensor may comprise an optical differential sensor configured to determine an orientation of the head of the user relative to the body by detecting light reflected from the body.

The differential orientation sensor may comprise an acoustic differential sensor configured to determine an orientation of the head of the user relative to the body by detecting audio reflected from the body.

The differential orientation sensor may comprise a physical differential sensor configured to determine an orientation of the head of the user relative to the body by detecting tension within cables coupling the head of the user to the apparatus.

The method may further comprise receiving at least one audio signal, and controlling at least one function of the apparatus based on the first orientation value comprises controlling a spatial processing of the at least one audio signal based on the first orientation value of the head of the user of the apparatus relative to the further body part of the user.

The method may further comprise determining at least one first filter from a database comprising a plurality of filters based on the first orientation value; and applying the at least one first filter to the at least one audio signal to generate a first output signal to generate at least one spatially processed audio signal.

The method may further comprise receiving at least one audio signal, and wherein controlling at least one function of the apparatus based on the first orientation value may comprise controlling a spatial processing of the at least one audio signal based on the first orientation value of the head of the user of the apparatus relative to the further body part of the user comprising: determining at least one first filter based on a difference value defined by a difference between the first absolute orientation value and the second orientation value; applying the at least one first filter to the at least one audio signal to generate a first output signal associated with the orientation of the further body part of the user; determining at least one second filter based on the first absolute orientation value; applying the at least one second filter to the at least one audio signal to generate a second output signal associated with the orientation of the head of the user relative to a reference orientation; and combining the first output signal and second output signal to generate at least one spatially processed audio signal.

Determining at least one first filter based on the difference value may comprise determining the at least one first filter from a database comprising a plurality of filters based on the difference value.

Determining at least one second filter based on the first absolute orientation value may comprise determining the at least one second filter from a database comprising a plurality of filters based on the first absolute orientation value.

Controlling at least one function of the apparatus based on the first orientation value may comprise controlling a playback of an audio signal based on the first orientation value.

Controlling at least one function of the apparatus based on the first orientation value may comprise controlling the apparatus based on determining a gesture based on the first orientation value.

According to a third aspect there is provided an apparatus comprising: means for determining a first orientation value of a head of a user of the apparatus relative to a further body part of the user using at least one orientation sensor; and means for controlling at least one function of the apparatus based on the first orientation value.

The means for determining a first orientation value of a head of a user of the apparatus relative to a further body part of the user using at least one orientation sensor may comprise: means for determining a first absolute orientation value of a head of the user relative to a reference orientation using a head mounted orientation sensor; means for determining a second absolute orientation value of the further body part of the user relative to a further reference value using a further body located sensor.

The means for controlling at least one function of the apparatus based on the first orientation value may further comprise means for controlling the at least one function based on the first absolute orientation value and the second absolute orientation value.

The apparatus may further comprise; means for determining a relationship between the reference orientation and the further reference orientation; and means for determining the first orientation value based on the first absolute orientation value and the second absolute orientation value.

The reference orientation may be the further reference orientation.

The head mounted orientation sensor may be located within at least one of the following: a headphone set; a headset; a head worn camera; and an earpiece.

The further body located sensor may be located within at least one of the following located on or worn by the user: a user equipment; a fitness band; a heart rate monitor; a smart watch; and a mobile or wearable device.

The at least one orientation sensor may be a differential orientation sensor configured to determine an orientation of the head of the user relative to the further body part directly.

The differential orientation sensor may comprise an optical differential sensor configured to determine an orientation of the head of the user relative to the body by detecting light reflected from the body.

The differential orientation sensor may comprise an acoustic differential sensor configured to determine an orientation of the head of the user relative to the body by detecting audio reflected from the body.

The differential orientation sensor may comprise a physical differential sensor configured to determine an orientation of the head of the user relative to the body by detecting tension within cables coupling the head of the user to the apparatus.

The apparatus may further comprise means for receiving at least one audio signal, and the means for controlling at least one function of the apparatus based on the first orientation value comprises means for controlling a spatial processing of the at least one audio signal based on the first orientation value of the head of the user of the apparatus relative to the further body part of the user.

The apparatus may further comprise means for determining at least one first filter from a database comprising a plurality of filters based on the first orientation value; and means for applying the at least one first filter to the at least one audio signal to generate a first output signal to generate at least one spatially processed audio signal.

The apparatus may further comprise means for receiving at least one audio signal, and wherein the means for controlling at least one function of the apparatus based on the first orientation value may comprise means for controlling a spatial processing of the at least one audio signal based on the first orientation value of the head of the user of the apparatus relative to the further body part of the user comprising: means for determining at least one first filter based on a difference value defined by a difference between the first absolute orientation value and the second orientation value; means for applying the at least one first filter to the at least one audio signal to generate a first output signal associated with the orientation of the further body part of the user; means for determining at least one second filter based on the first absolute orientation value; means for applying the at least one second filter to the at least one audio signal to generate a second output signal associated with the orientation of the head of the user relative to a reference orientation; and means for combining the first output signal and second output signal to generate at least one spatially processed audio signal.

The means for determining at least one first filter based on the difference value may comprise means for determining the at least one first filter from a database comprising a plurality of filters based on the difference value.

The means for determining at least one second filter based on the first absolute orientation value may comprise means for determining the at least one second filter from a database comprising a plurality of filters based on the first absolute orientation value.

The means for controlling at least one function of the apparatus based on the first orientation value may comprise means for controlling a playback of an audio signal based on the first orientation value.

The means for controlling at least one function of the apparatus based on the first orientation value may comprise means for controlling the apparatus based on determining a gesture based on the first orientation value.

A computer program product stored on a medium for causing an apparatus to perform the method as discussed herein.

According to a fourth aspect an apparatus comprising at least one processor and at least one memory including computer code for one or more programs, the at least one memory and the computer code configured to with the at least one processor cause the apparatus to at least perform: determine a first orientation value of a head of a user of the apparatus relative to a further body part of the user using at least one orientation sensor; and control at least one function of the apparatus based on the first orientation value.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

The following describes in further detail suitable apparatus and possible mechanisms for the provision of effective headtracking and specifically in some embodiments for spatial audio signal processing. In the following examples, audio signals and audio capture signals are described. However it would be appreciated that in some embodiments the differential headtracking may be part of any suitable electronic device or apparatus comprising a headtracking input.

Conventional headtracking uses one sensor or a sensor array monitoring a single orientation change, the 'head' orientation. However conventional headtracking algorithms are only effective for an immobile user, where the head orientation is referenced to an 'earth' or similar reference orientation. In such systems head orientation change cannot be distinguished from 'body' or torso orientation change. For example, when a user is in a vehicle, conventional headtracking methods cannot detect whether the user is turning his head or the vehicle itself is turning. This makes headtracking control input difficult to implement. For example where 3D audio rendering is controlled by conventional headtracking, the listener's sound scene may be rotated when the vehicle rotates or is rotated rather than when the users head rotates or moves. This may not be the desired function, if the desired application is one which is dependent only on the head motion independent of the motion of the body/carrier. Thus this can for example be perceived as erroneous functionality in most 3D audio applications.

The concept as described with respect to the embodiments herein makes it possible to track the motion of a mobile user more effectively, in other words to track a first body part (for example the head) relative to a further body part (for example the user's torso or a carrier of the user) of the user.

The concept may for example be embodied as a mobile headtracking system to control 3D audio reproduction. In such implementations a first sensor (or sensor array) is mounted on listener's headset (for determining and tracking a first orientation such as the head orientation and motion) and a second sensor (or sensor array) on a listener's mobile phone (for determining and tracking a second orientation such as the torso or carrier orientation and motion). The outputs from these sensors may be passed to a differential head-tracker which is used to determine the first (head) orientation relative to the second (torso) orientation.

In some embodiments the differential headtracking may be implemented as an input for audio signal processing, such as 3D audio rendering, which may then be controlled using listener's torso and head orientation parameters separately. The arrangements as described herein therefore makes it possible to detect head motion of a listener or user relative to a torso motion and enable realistic high-end 3D audio reproduction.

Figure 9:
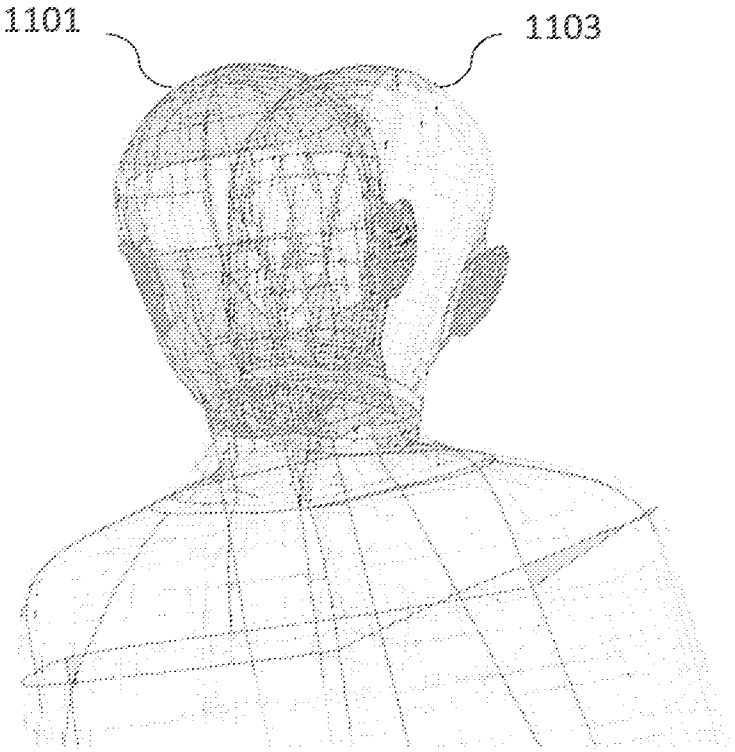
FIG. 9 shows an example user head turn motion.

In a conventional headtracking spatial processor, the head orientation signal controls a listener orientation parameter of a positional 3D audio processor to produce suitable left and right channel audio signals (from a mono audio signal input not shown). In HRTF-based systems head-related impulse responses (HRIR) are measured from a human or a mannequin (artificial head and torso). The head orientation in these measurements typically points forwards. Thus, changing the listener orientation in the audio processor simulates a situation where whole listener rotates rather than the head of the listener. In real world, it is more typical that the listener rotates their head relative to their torso rather than rotate the whole torso. This for example is shown in FIG. 9 where the user in a first position 1103 rotates their head relative to their torso to reach a second position 1101.

Figure 10B:
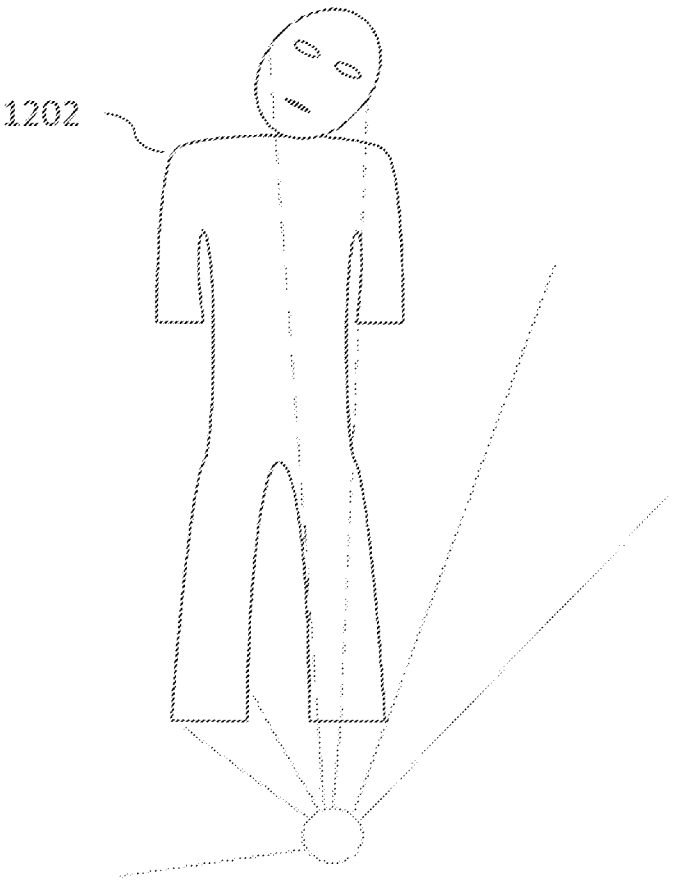
FIG. 10 shows a user sideways neck bend motion error in conventional headtracking spatial processing.
Figure 10A:
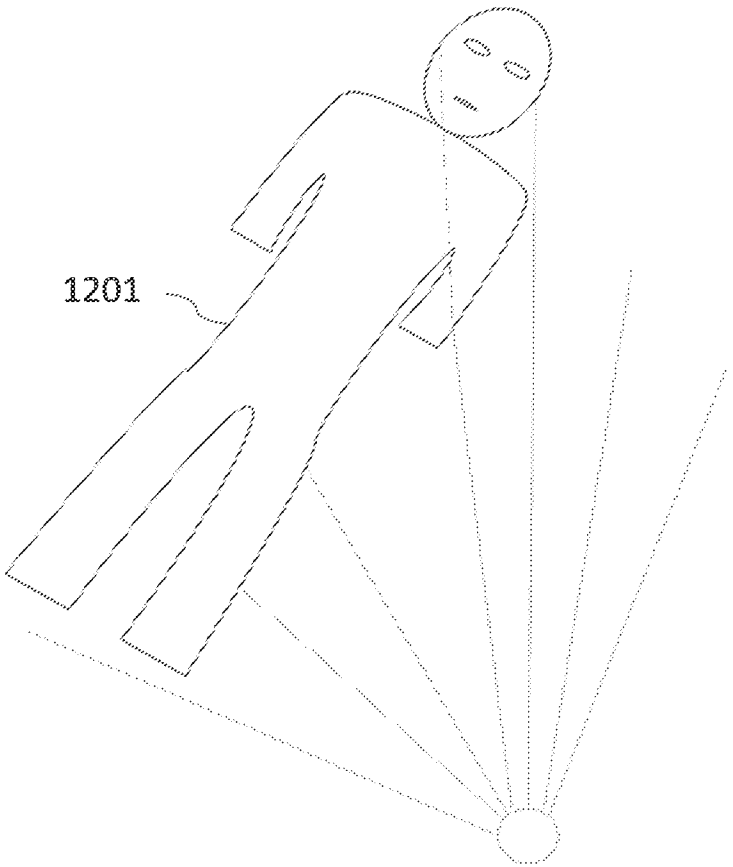

The difference between rotating the whole torso and rotating the head relative to the torso is small, but may be crucial in certain situations. An example of which is shown in FIGS. 10*a* and 10*b* where a problem which may arise with conventional headtracking system is shown. In these examples the sound source 1201 is positioned below the listener and the listener bends their head sideways to 'focus' on listening to the sound source. Although, the shadowing effect of listener's torso should not diminish due to the head movement such as shown in FIG. 10*b* by the torso 1205 still shadowing the sound source 1201, the static head-torso model 1201 example as shown in FIG. 10*a* by the torso 1203 would result in a significant reduction in the shadowing effect.

Furthermore although 3D algorithms are able to spatialize sounds to the horizontal plane and achieve reasonable localization performance, spatializing sounds to different height levels is very challenging. Several factors affect the perception of height and are taken into account in the embodiments discussed below.

The differential headtracking methods and apparatus described herein provide a realistic way to model dynamic head and torso effects on audio source localization. In such a manner the differential headtracking methods and apparatus described herein are suitable to be used in a mobile environment.

Figure 1:
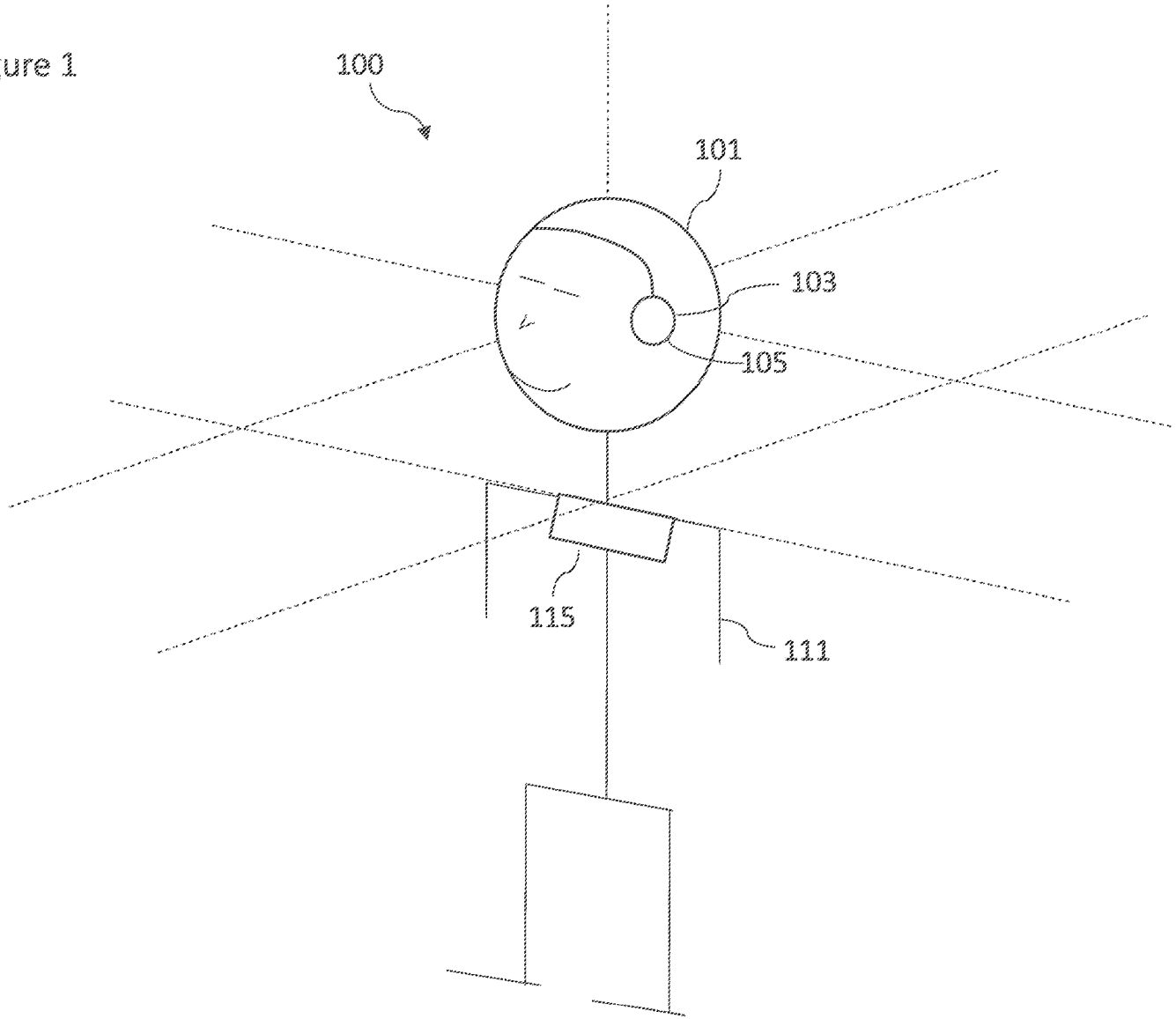
FIG. 1 shows schematically a user worn differential headtracking sensor array apparatus suitable for communicating with a spatial audio processor for implementing spatial audio signal processing according to some embodiments.

With respect to FIG. 1 an example shows schematically a user worn differential headtracking sensor array apparatus suitable for communicating with a differential headtracking apparatus according to some embodiments.

The user 100 (or listener) is shown with a first body or head 101 at a first orientation $\phi_H=[\phi h_x, \phi h_y, \phi h_z]$(or other suitable co-ordinate system representation). The user may be wearing a set of earphones 103 (also known as headphones, headset, etc.) for outputting an audio signal to the user. The earphones 103 may comprise a first body or head orientation sensor 105. The first body (head) orientation sensor 105 may be any suitable orientation determination means such as those described above. For example the first body (head) orientation sensor 105 may comprise a digital compass, a gyroscope etc. In some embodiments the head mounted orientation sensor is located within a head worn camera and may for example be the images captured by the camera used to determine the orientation of the head.

Furthermore the user 100 is shown with a further body or torso 111 at a second orientation $\phi_B=[\phi b_x, \phi b_y, \phi b_z]$ (or other suitable co-ordinate system representation). The second orientation may be determined by a further body or torso orientation sensor 115 which may be located on the further body or torso 111. The further body or torso orientation sensor 115 may be any suitable orientation determination means such as those described above. For example the further body orientation sensor 115 may comprise a digital compass, a gyroscope etc. In some embodiments the further body orientation sensor 115 may be body of a user device or mobile device such as a mobile phone. The further body orientation sensor 115 as part of the user device may for example be located on the user by the user placing the user device in a pocket, holding the device etc. In some embodiments the user device may also be in communication with the earphones 103 and furthermore comprise the differential headtracking processor (or differential headtracking spatial audio processor) apparatus. In some embodiments the further body located sensor may be a fitness band, a heart rate monitor, a smart watch or any suitable mobile or wearable device.

In the examples described herein the further body orientation sensor 115 is an example of a general carrier orientation sensor. The carrier orientation sensor may be a sensor determining an orientation of a carrier or torso on (or in) which the user or listener is carried. For example a carrier may be a vehicle on (or in) which the listener is located. For example the carrier orientation sensor in some embodiments may be part of a vehicle in car entertainment system or satellite navigation system and thus provide a carrier orientation against which the head orientation may be compared as discussed herein.

Figure 2:
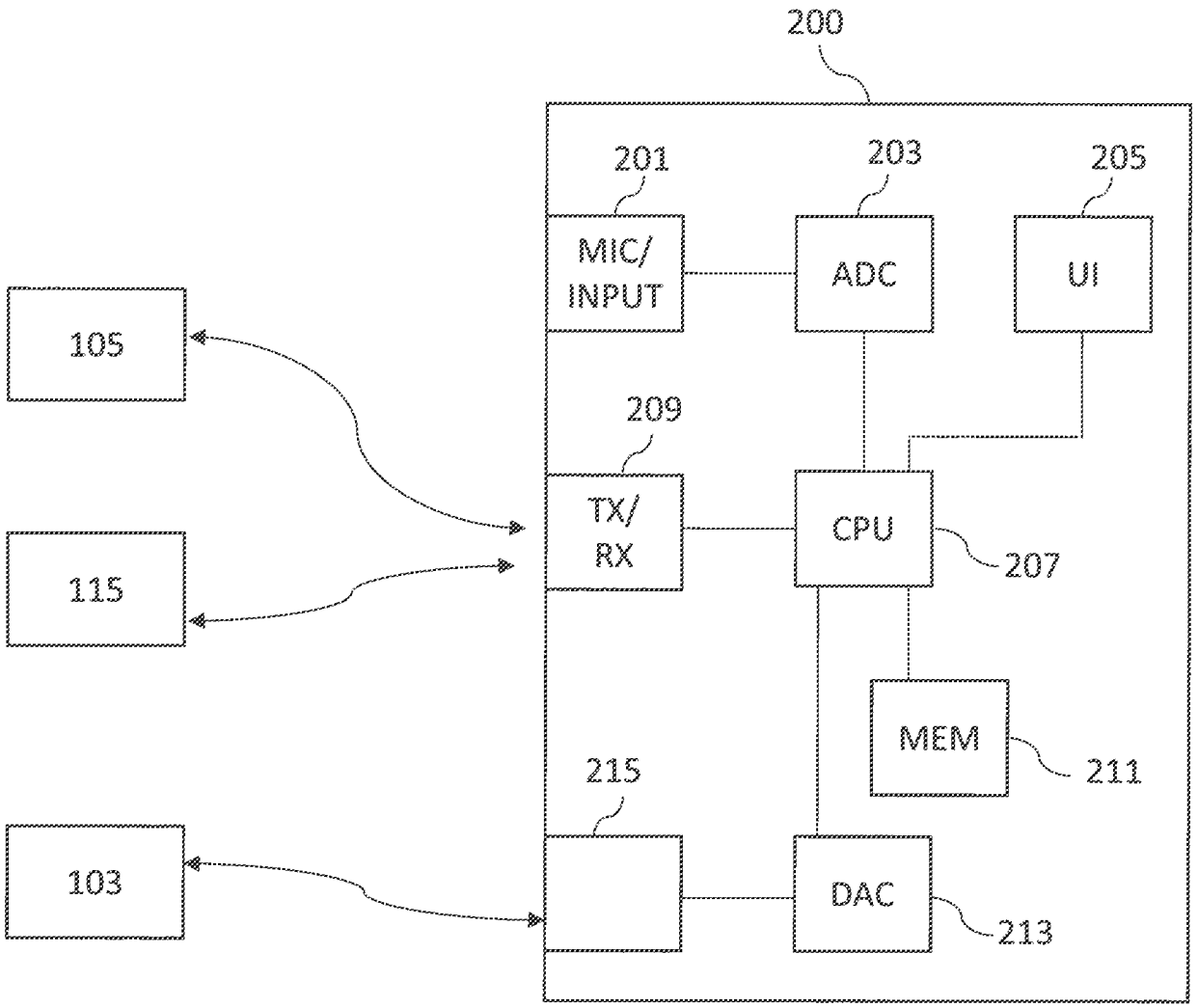
FIG. 2 shows schematically a spatial audio processor apparatus suitable for communicating with a user worn differential headtracking sensor array as shown in FIG. 1 and suitable for implementing spatial audio signal processing according to some embodiments.

With respect to FIG. 2 a differential headtracking (spatial audio) processor apparatus suitable for communicating with a user worn differential headtracking sensor array as shown in FIG. 1 and suitable for implementing differential headtracking (and for example differential headtracking spatial audio signal processing) is shown. The differential headtracking apparatus may be any suitable electronics device or apparatus. For example in some embodiments the spatial audio processor apparatus is a user equipment, tablet computer, computer, audio playback apparatus, in car entertainment, satellite navigation audio system etc.

The differential headtracking apparatus 200 may comprise a microphone array 201. The microphone array 201 may comprise a plurality (for example a number N) of microphones. However it is understood that there may be any suitable configuration of microphones and any suitable number of microphones. In some embodiments the microphone array 201 is separate from the apparatus and the audio signals transmitted to the apparatus by a wired or wireless coupling.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 203.

The differential headtracking processor apparatus 200 may further comprise an analogue-to-digital converter 203. The analogue-to-digital converter 203 may be configured to receive the audio signals from each of the microphones in the microphone array 201 and convert them into a format suitable for processing. In some embodiments where the microphones are integrated microphones the analogue-to-digital converter is not required. The analogue-to-digital converter 203 can be any suitable analogue-to-digital conversion or processing means. The analogue-to-digital converter 203 may be configured to output the digital representations of the audio signals to a processor 207 or to a memory 211.

In some embodiments the differential headtracking apparatus 200 comprises at least one processor or central processing unit 207. The processor 207 can be configured to execute various program codes. The implemented program codes can comprise, for example, differential headtracking control, spatial audio signal processing and other code routines such as described herein.

In some embodiments the differential headtracking apparatus 200 comprises a memory 211. In some embodiments the at least one processor 207 is coupled to the memory 211. The memory 211 can be any suitable storage means. In some embodiments the memory 211 comprises a program code section for storing program codes implementable upon the processor 207. Furthermore in some embodiments the memory 211 can further comprise a stored data section for storing data, for example data that has been processed or to be processed in accordance with the embodiments as described herein. The implemented program code stored within the program code section and the data stored within the stored data section can be retrieved by the processor 207 whenever needed via the memory-processor coupling.

In some embodiments the differential headtracking apparatus 200 comprises a user interface 205. The user interface 205 can be coupled in some embodiments to the processor 207. In some embodiments the processor 207 can control the operation of the user interface 205 and receive inputs from the user interface 205. In some embodiments the user interface 205 can enable a user to input commands to the differential headtracking apparatus 200, for example via a keypad. In some embodiments the user interface 205 can enable the user to obtain information from the apparatus 200. For example the user interface 205 may comprise a display configured to display information from the apparatus 200 to the user. The user interface 205 can in some embodiments comprise a touch screen or touch interface capable of both enabling information to be entered to the apparatus 200 and further displaying information to the user of the apparatus 200.

In some implements the differential headtracking apparatus 200 comprises a transceiver 209. The transceiver 209 in such embodiments can be coupled to the processor 207 and configured to enable a communication with other apparatus or electronic devices, for example via a wireless communications network. The transceiver 209 or any suitable transceiver or transmitter and/or receiver means can in some embodiments be configured to communicate with other electronic devices or apparatus via a wire or wired coupling.

For example as shown in FIG. 2 the transceiver 209 may be configured to communicate with the first body (head) orientation sensor 105 and the further body (torso) orientation sensor 115.

The transceiver 209 can communicate with further apparatus by any suitable known communications protocol. For example in some embodiments the transceiver 209 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the differential headtracking apparatus 200 comprises a digital-to-analogue converter 213. The digital-to-analogue converter 213 may be coupled to the processor 207 and/or memory 211 and be configured to convert digital representations of audio signals (such as from the processor 207) to a suitable analogue format suitable for presentation via an audio subsystem output. The digital-to-analogue converter (DAC) 213 or signal processing means can in some embodiments be any suitable DAC technology.

Furthermore the differential headtracking apparatus 200 can comprise in some embodiments an audio subsystem output 215. An example as shown in FIG. 2 the audio subsystem output 215 is output socket configured to enabling a coupling with the earphones 103. However the audio subsystem output 215 may be any suitable audio output or a connection to an audio output. For example the audio subsystem output 215 may be a connection to a multichannel speaker system.

In some embodiments the digital to analogue converter 213 and audio subsystem 215 may be implemented within a physically separate output device. For example the DAC 213 and audio subsystem 215 may be implemented as cordless earphones communicating with the differential headtracking apparatus 200 via the transceiver 209.

Although the differential headtracking apparatus 200 is shown having both audio capture and audio presentation components, it would be understood that in some embodiments the apparatus 200 can comprise just the audio presentation elements such that the microphone (for audio capture) and ADC components are not present. Similarly in some embodiments the audio capture components may be separate from the differential headtracking apparatus 200. In other words audio signals may be captured by a first apparatus comprising the microphone array and a suitable transmitter. The audio signals may then be received and processed in a manner as described herein in a second apparatus comprising a receiver and processor and memory.

Figure 3C:
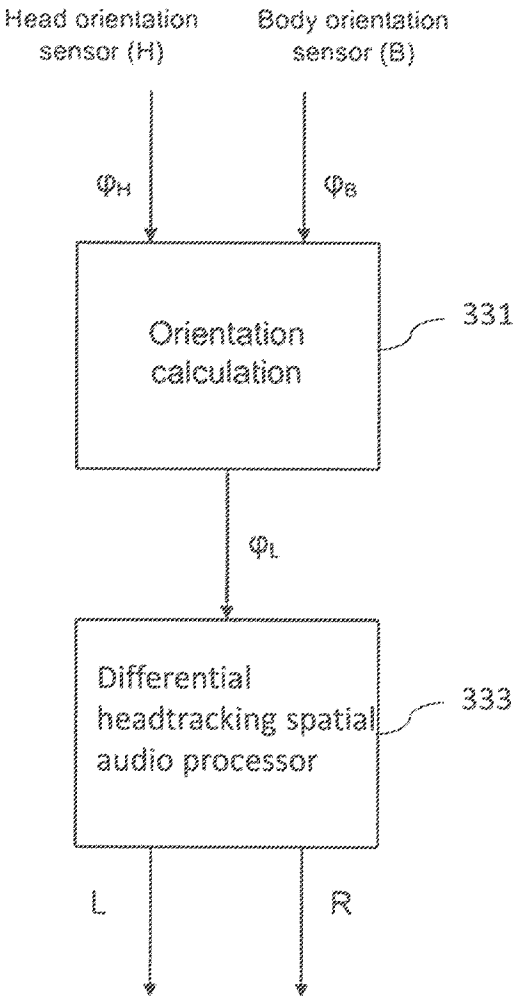
FIGS. 3*a* to 3*c* show schematically differential headtracking processors according to some embodiments.
Figure 3B:
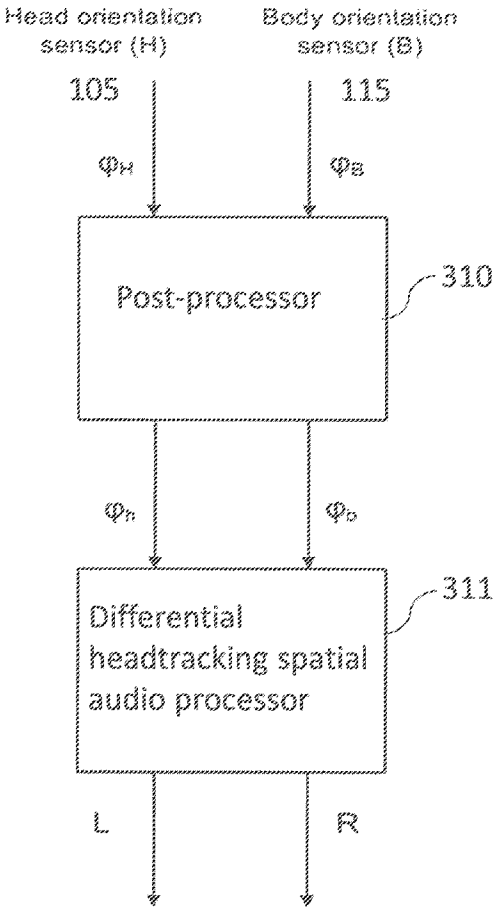
Figure 3A:
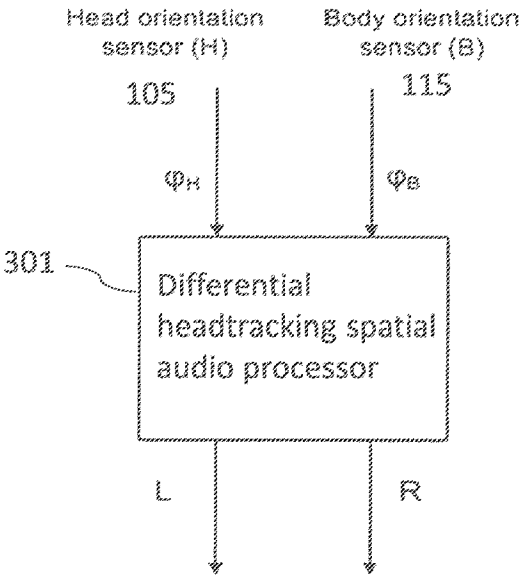

With respect to FIGS. 3*a* to 3*c* differential headtracking processors according to some embodiments are shown. The differential headtracking processors may be implemented as software or as applications stored in the memory as shown in FIG. 2 and executed on the processor also as shown in FIG. 2. However it is understood that in some embodiments the differential headtracking may be at least partially a hardware implementation.

FIG. 3*a* shows a first example differential headtracking spatial audio processor 301. The differential headtracking audio processor 301 is configured to receive at a first input the first body (head) orientation sensor 105 orientation $\phi_H=[\phi h_x, \phi h_y, \phi h_z]$ and furthermore configured to receive at a second input the further body (torso) orientation sensor 115 orientation $\phi_B=[\phi b_x, \phi b_y, \phi b_z]$. Furthermore the differential headtracking spatial audio processor 301 is configured to receive an input audio signal or signals to be processed. For example in some embodiments the input audio signals comprise a mid signal and an associated orientation indicator. The mid signal and associated orientation indicator may represent a dominant audio source within an audio scene and a side signal representing the ambience within the audio scene.

In some embodiments the sensors report the orientations or coordinate systems, which are represented as 3×3 orthonormal matrices $R_H$ and $R_B$. The columns of these matrices represent the three orthogonal measurement axes of the sensor in the (earth) reference coordinate system. In some embodiments quarternions are used.

In some embodiments the differential headtracking spatial audio processor 301 may be configured to combine the $R_H$ and $R_B$ matrices to obtain the first body (head) orientation relative to virtual sound scene. For example where the sound scene is assumed to be fixed relative to the further body (torso), e.g. when sitting in a vehicle and the sound scene is assumed fixed to the vehicle, the orientation of the first body (head) relative to sound scene may be determined as $$R_R=R_B^{-1}R_H.$$

When the sound scene is fixed to a (earth) reference coordinate system, then RH directly gives the orientation of the head relative to sound scene.

In some embodiments the differential headtracking spatial audio processor 301 may be configured to process the audio signals by applying minimum phase HRTF filters to generate left and right channel audio signals.

A high quality localization result can be achieved when filter lengths above 1.0 ms are used. As sound waves propagate ~34 cm in one millisecond, in order to achieve good quality audio signal output that in addition to pinnae and head effect the influence of torso and, especially, shoulder reflection should be modeled by the filter. Shoulder reflection for example is one factor that seems to have significant importance in localization of sounds at different levels of elevation.

The differential headtracking spatial audio processor 301 may furthermore implement the headtracked positional 3D audio algorithm in some embodiments based on retrieving or looking up different first-further body (head-torso) orientation combinations from at least one HRTF database in order to extract the HRFT filter pair parameters and apply these filters to the audio signal (for example the mid signal) in order to generate the 3D spatialized audio scene represented as left and right channel audio signals.

In such embodiments the at least one HRTF database may comprise several parallel HRTF databases. In such implementations each database contains filters for a specific combination of azimuth and elevation first-second (head-torso) combinations. This implementation is processor friendly as it employs pre-configured values stored in memory.

In some embodiments the differential headtracking spatial audio processor 301 may furthermore implement a parametric model of head orientation relative to torso orientation in order to generate the HRFT filter pair parameters and apply these filters to the audio signal in a manner similar to above.

In such embodiments parametric filters are used to model first-further body (head-torso) orientation effects.

Figure 4:
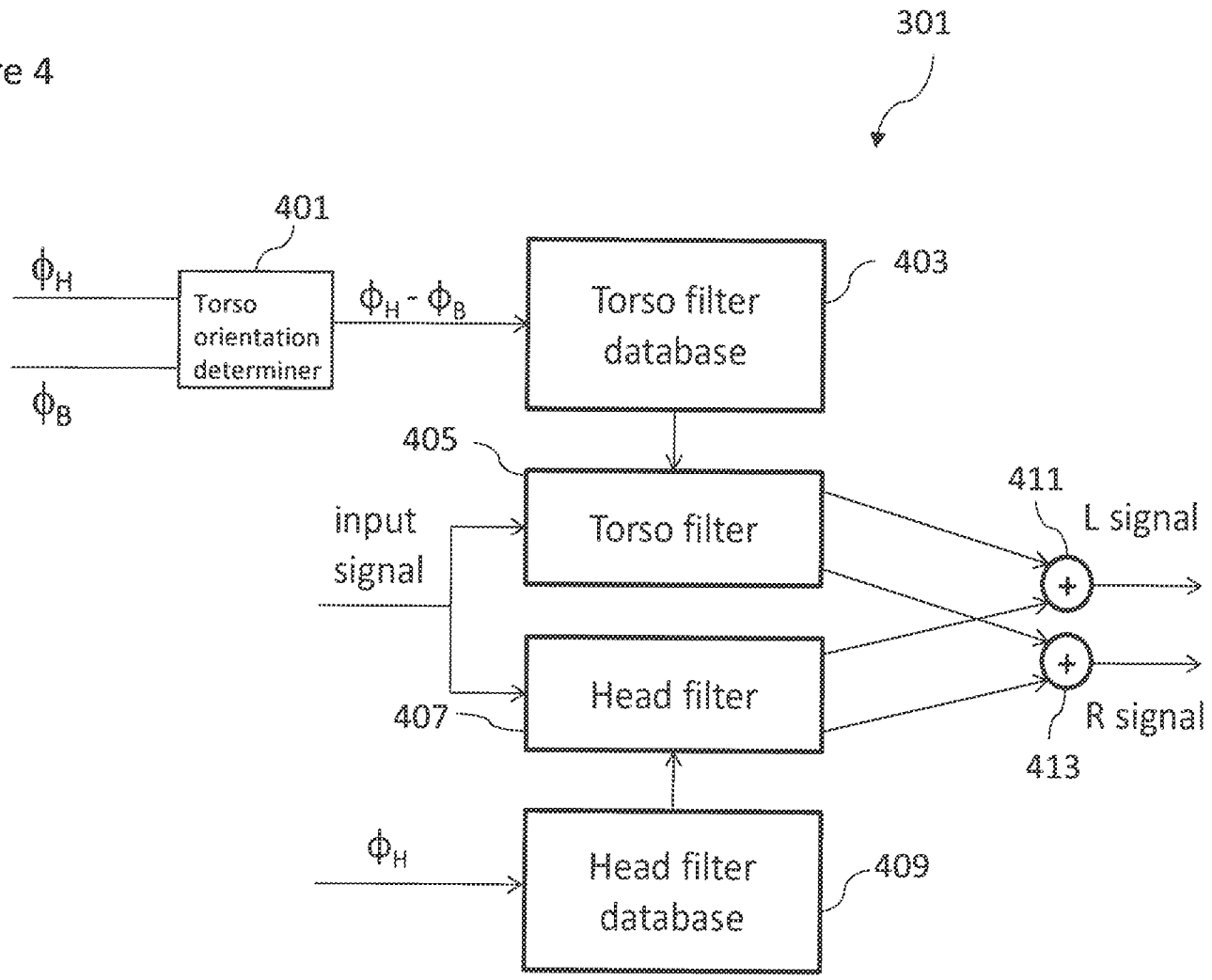
FIG. 4 shows an example differential headtracking spatial audio processor as shown in FIG. 3*a* in further detail according to some embodiments.

An example parametric model configuration may include a parallel filter structure of first-second (head and torso) orientations is shown in FIG. 4.

The differential headtracking spatial audio processor 301 may comprise a torso orientation determiner 401. The torso orientation determiner 401 may be configured to receive the first body (head) $\phi_H$ and further body (torso) $\phi_B$ orientation values and determine the difference (in a manner such as described above) $\phi_H$-$\phi_B$. The torso orientation may then be passed to a torso filter database 403. The torso orientation determiner 401 may in some other embodiments represent a carrier orientation determiner or torso orientation determiner. In other words the torso orientation determiner 401 (or suitable application) is configured to determine the orientation of the carrier, or torso (the further body) relative to the head (first body) orientation.

The differential headtracking spatial processor 301 may furthermore comprise a torso filter database 403 which based on the torso orientation input and may be configured to output filter coefficients from the database and pass these coefficients to a torso filter 405.

The differential headtracking spatial processor 301 may in some embodiments comprise a torso filter 405. The torso filter 405 may be configured to receive the filter coefficients from the torso filter database 403 and furthermore receive the input audio signal and generate a left channel torso output and a right channel torso output. The left channel torso output may be passed to a left channel generator 411 and the right channel torso output may be passed to a right channel generator 413.

The differential headtracking spatial processor 301 may furthermore comprise a head filter database 409 which based on the head orientation input and may be configured to output filter coefficients from the databases and pass these coefficients to a head filter 407.

The differential headtracking spatial processor 301 may in some embodiments comprise a head filter 407. The head filter 407 may be configured to receive the filter coefficients from the head filter database 409 and furthermore receive the input audio signal and generate a left channel head output and a right channel head output. The left channel head output may be passed to a left channel generator 411 and the right channel head output may be passed to a right channel generator 413.

The differential headtracking spatial processor 301 may furthermore in some embodiments comprise a left channel generator 411 configured to combine the left channel torso output and the left channel head output to generate the left channel output. The left channel output may for example be passed to a left channel earphone.

The differential headtracking spatial processor 301 may furthermore in some embodiments comprise a right channel generator 413 configured to combine the right channel torso output and the right channel head output to generate the right channel output. The right channel output may for example be passed to a right channel earphone.

Figure 5:
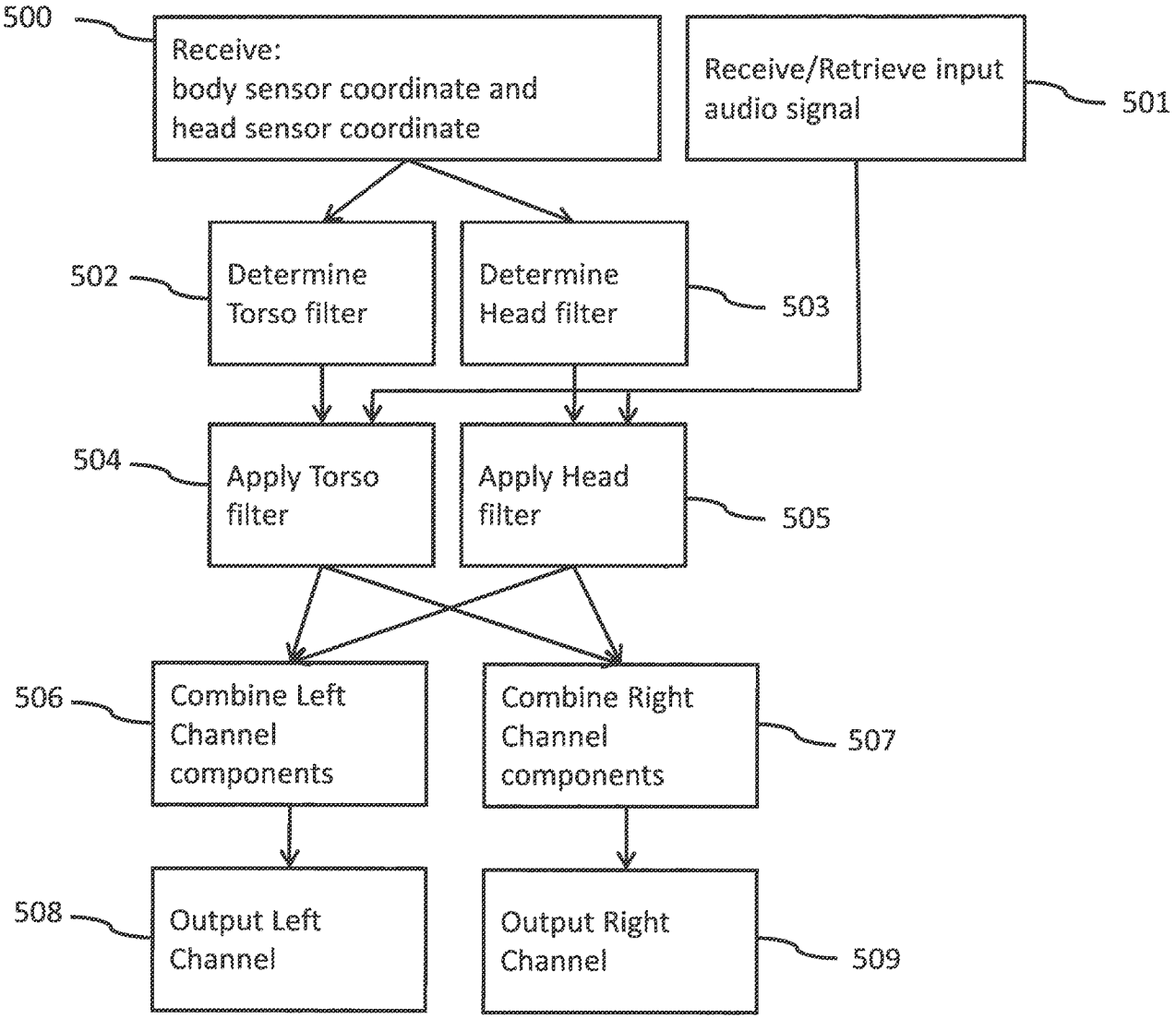
FIG. 5 shows a flow diagram of the operation of the differential headtracking spatial audio processors according to some embodiments.

With respect to FIG. 5 the flow diagram of the operation of the differential headtracking spatial audio processor 301 shown in FIG. 3*a* and further described with respect to FIG. 4 is shown.

The differential headtracking spatial audio processor may in some embodiments be configured to receive the further body (torso) sensor orientation $\phi_B$ values and the first body (head) sensor orientation $\phi_H$ values.

The operation of receiving the further body (torso) sensor orientation $\phi_B$ values and the first body (head) sensor orientation $\phi_H$ values is shown in FIG. 5 by step 500.

The differential headtracking spatial audio processor may furthermore determine a torso filter value. This may be performed by generating a torso orientation $\phi_H$-$\phi_B$ (or torso relative to the first body (head) orientation) and then using this to determine (either by look up table or parametrically) torso HRTF filter pair parameters.

The operation of determining torso filter values is shown in FIG. 5 by step 502.

The differential headtracking spatial audio processor may furthermore determine a first body or head filter value. This may be performed by using the first body (head) orientation $\phi_H$ and then using this to determine (either by look up table or parametrically) head HRTF filter pair parameters.

The operation of determining first body (head) filter values is shown in FIG. 5 by step 503.

Furthermore, and in parallel to the above operations, the differential headtracking spatial audio processor may receive or retrieve an input audio signal to be processed.

The operation of receiving or retrieving the input audio signal is shown in FIG. 5 by step 501.

The differential headtracking spatial audio processor may furthermore be configured to apply a torso filter to the received/retrieved audio signals. For example the input audio signal may be filtered by the torso HRTF filter pair parameters to generate a left channel torso output and a right channel torso output.

The operation of applying a torso filter to the audio signal is shown in FIG. 5 by step 504.

The differential headtracking spatial audio processor may furthermore be configured to apply a first body (head) filter to the audio signal. For example the input audio signal may be filtered by the first body (head) HRTF filter pair parameters to generate a left channel head output and a right channel head output.

The operation of applying a first body (head) filter to the audio signal is shown in FIG. 5 by step 505.

The differential headtracking spatial audio processor may furthermore combine the left channel torso output and the left channel head output to generate the left channel output.

The operation of combining the left channel components is shown in FIG. 5 by step 506.

Thus in other words measurements or simulations of the HRTF with head and torso aligned is equal to the HeadFilter. Any measurements or simulations of HRTF with torso rotated from to a non-aligned position is equal to the Total filter to be used in rendering (TotalFilter). Furthermore the Torso Filter may be defined in the frequency domain by equation TorsoFilter*HeadFilter=TotalFilter.

Hence the TorsoFilter may be considered to be the TotalFilter/HeadFilter. These filter values in some embodiment are precomputed to the database. In the time domain, the TorsoFilter may have an echo channel that is longer than the 'distance' to the ear. Thus in some embodiments a more efficient filter may be created by compressing the TorsoFilter using a time delay at the beginning.

The differential headtracking spatial audio processor may furthermore be configured to output the combined left channel components as the left channel output audio signal. The left channel output may for example be passed to a left channel earphone.

The operation of outputting the left channel output audio signal is shown in FIG. 5 by step 508.

The differential headtracking spatial audio processor may furthermore combine the right channel torso output and the right channel head output to generate the right channel output.

The operation of combining the right channel components is shown in FIG. 5 by step 507.

The differential headtracking spatial audio processor may furthermore be configured to output the combined right channel components as the right channel output audio signal. The right channel output may for example be passed to a right channel earphone.

The operation of outputting the right channel output audio signal is shown in FIG. 5 by step 509.

In other words in some embodiments the system comprises some suitable means for determining first orientation value of a head of a user of the apparatus relative to a further body part of the user (for example by using at least one orientation sensor) and furthermore a suitable means for determine a further orientation value of the further body part of the user (for example by using a further orientation sensor mounted on a device carried and associated with the further body part). Furthermore in some embodiments the system comprises a processor configured to determine at least one first filter and/or filter parameter set based on a difference value defined by a difference between the first orientation value and the further orientation value. This first filter may then be applied to the at least one audio signal to generate a first output signal associated with the orientation of the further body part of the user. In such embodiments the processor may be further configured to determine at least one second filter based on the first orientation value and then apply the at least one second filter to the at least one audio signal to generate a second output signal associated with the orientation of the head of the user relative to a reference orientation. The processor may furthermore be configured to combine the first output signal and second output signal to generate at least one spatially processed audio signal.

However in some implementations the processor may be configured to determine at least one first filter from a database comprising a plurality of filters based on a difference value defined by a difference between the first orientation value and the further orientation value and furthermore the first orientation value. In other words use as inputs the difference value and the first orientation value to determine a suitable filter from a database of filters. This determined filter may then be applied to the at least one audio signal to generate a first output signal to generate at least one spatially processed audio signal.

In some embodiments, since a database with all head positioning variants would be extremely laborious to create by measurements, numerical simulations are employed to produce the database based on a basic individual 3D model of the torso, head and pinna are provided with parameterized movements.

In such embodiments the parameterized movement system enables the operation to start from a static 3D model with dynamical movement animated for the simulations. In such a manner practical means of gathering and commercializing dynamical, individualized HRTF data can be implemented.

The implementation of differential headtracking may for example be advantageous when one sensor is in the user's mobile phone and another in the earphones or headset. With respect to spatial audio signal processing implementations the use of differential headtracking between the mobile phone (equipped with the torso or carrier sensor) and the earphones (equipped with the head sensor) enables control of an output sound scene by moving the mobile phone relative to the headset.

Thus for example if a user is walking with the mobile phone in a pocket, the sound scene is locked to walking direction. When the user arrives at their destination or changes their mode of travel to car or public transport they can take their phone from their pocket and by changing the direction of the orientation of the mobile phone enable the orientation of the sound scene to be changed to an appropriate position.

In some embodiments the first body (head) and further body (torso) orientation sensor values may be processed before being used as inputs to the audio processor.

With respect to FIG. 3*b* an example of differential headtracking apparatus comprising sensor post processing is shown. FIG. 3*b* for example shows an apparatus comprising a post-processor 310 configured to receive the first body and further body orientation sensor orientations ($\phi_H$, $\phi_B$) and perform additional processing to the orientation signals to produce enhanced signals ($\phi_h$, $\phi_b$). These processed orientation signals may for example be passed to the differential headtracking spatial audio processor 301 such as described herein to control the audio rendering in a similar manner but by using the enhanced signals $\phi_h$, $\phi_b$) rather than the signals directly from the sensors ($\phi_H$, $\phi_B$).

The post processor 310 may in some embodiments perform error estimation and/or error correction. For example the sensor post processor 310 may be configured to receive the orientation values from the two sensor signals (one of this may be an orientation sensor within a device handled or carried by the user).

In some embodiments the post-processor 310 may furthermore receive at least one further input to determine whether the user is handling the phone and to furthermore control the processing based on the further input. For example the post-processor 310 may be configured to switch off or on a differential mode or apply calibration between the sensor outputs based on whether the user is handling the phone or other device comprising the orientation sensor.

In some embodiments the further input, for detecting if the orientation sensor device is being handled may be one of: detecting whether the device key lock is off; determining whether the device keys are being pressed; and an output from a separate sensor indicating that the phone is in the hand/being carried.

The implementation of the differential tracking principle which is shown with respect to spatial audio signal processing shown with respect to the apparatus shown in FIGS. 3*a* and 3*b* (and furthermore the audio processor shown in FIG. 4 and the method in FIG. 5) may be implemented in other applications. Thus for example FIG. 3*c* shows the implementation of a differential headtracking processor 331 which is configured to receive the first body (head) and further body (torso or carrier) sensor orientation values in a manner similar to those described herein. The differential headtracking processor 331 may be configured to determine the orientation of the head relative to the further body (torso or carrier), or in some embodiments vice versa the orientation of the further body (torso or carrier) relative to the head. The differential headtracking processor may then output the differential output $\phi_H$-$\phi_B$ to a gesture control application 333. The gesture control application 333 may be configured to receive the differential headtracking processor output and based on the value of the differential headtracking control the device in response to determining gestures. The gestures may be defined or pre-defined gestures. For example gesture control application 333 may be configured to recognize a defined gesture when user is moving and use this to control applications or functions of the device. Head gestures can be used for example to provide hands free control of a music (or video) player application. For example different movements of the head relative to the torso (or carrier) may enable control of functions such as play, stop, next, previous, volume up/volume down etc. Furthermore in some embodiments the head gesture may be used to reset a 'front direction' of the user within an audio playback operation.

The examples described above and shown in FIG. 1 feature a differential headtracking application being implemented based on two sensor inputs (one mounted or located on the head and the other on the torso or carrier). However in some embodiments a differential headtracking application may be configured to receive a differential orientation input directly from a sensor configured to observe the relative orientation of the head to the torso (or carrier).

Figure 6:
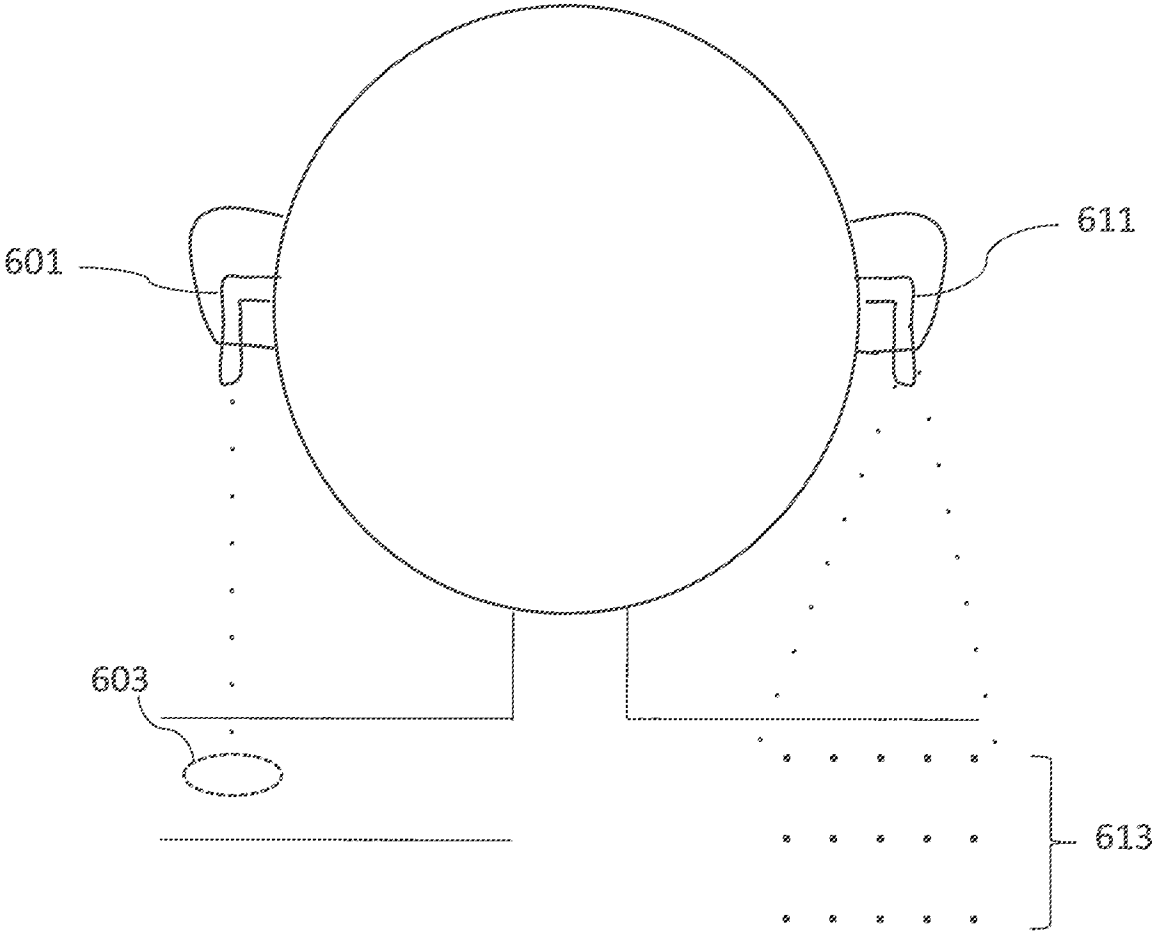
FIGS. 6 to 8 shows example differential headtracking sensors suitable for communicating with a spatial audio processor for implementing spatial audio signal processing according to some embodiments.
Figure 7:
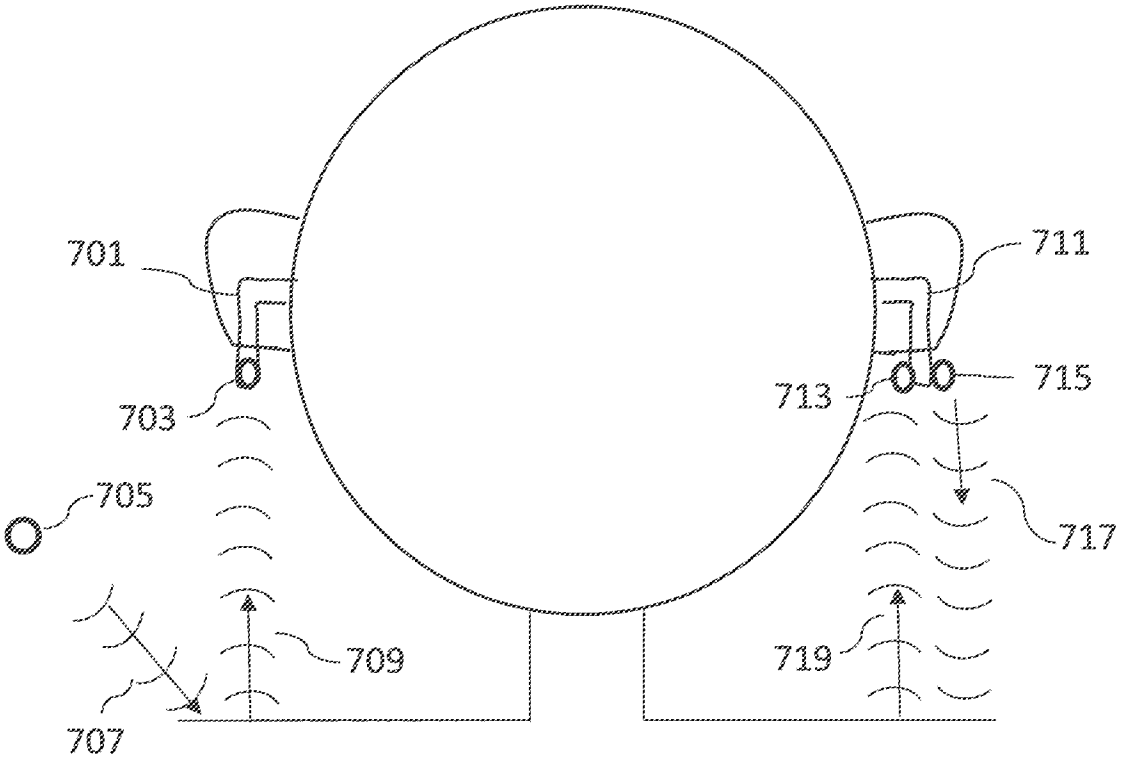
Figure 8:
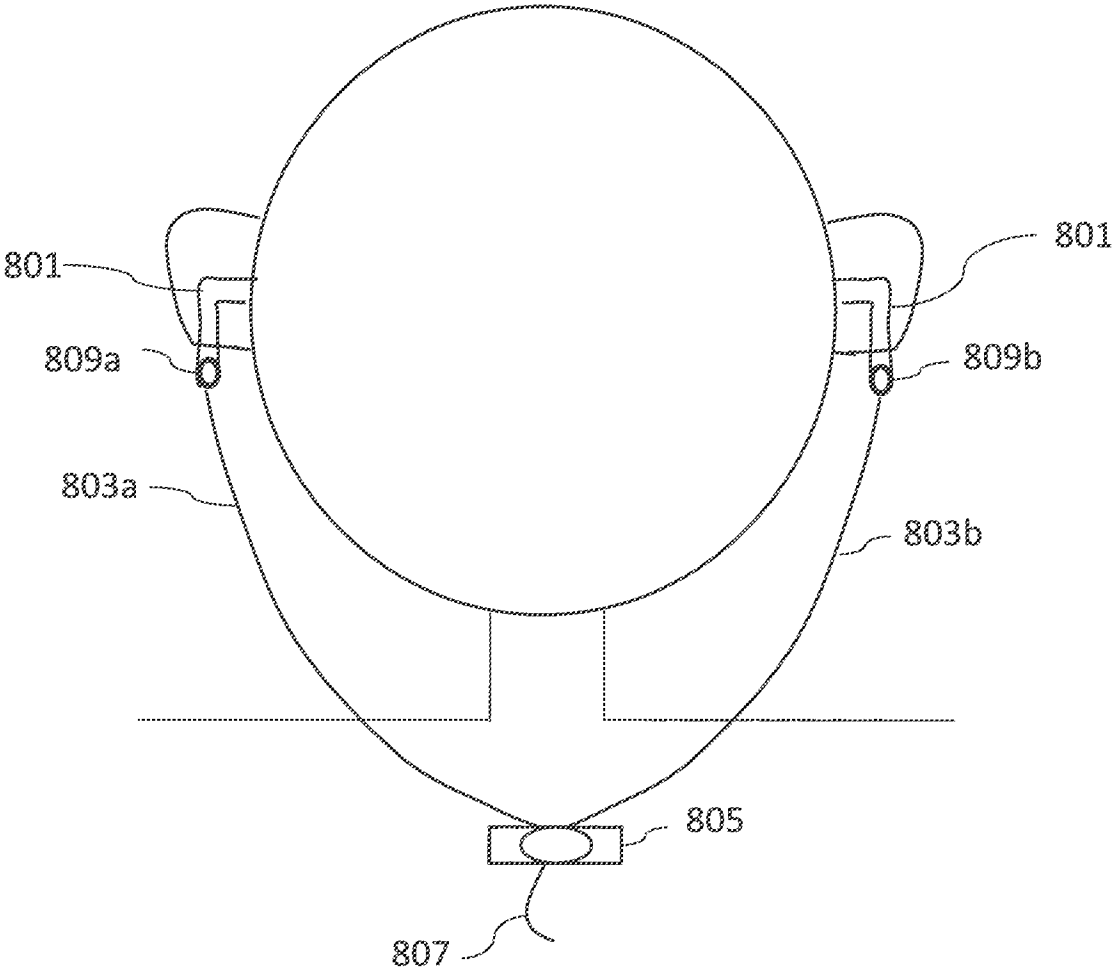

Examples of such differential orientation sensors are shown with respect to FIGS. 6 to 8. With respect to FIG. 6 a first series of differential orientation sensors are shown. In the examples shown in FIG. 6 the differential measurement of the relative head-torso orientation is based on a determined shoulder-head angle. For example in some embodiments the earphone comprises a time of arrival (TOA) or phase change distance determining optical sensor 601. For example the distance determining optical sensor 601 may be an infrared light source and sensor projecting (or illuminating) the shoulder area. The reflected light is measured and used to estimate the position of shoulders under the ear. In such a manner the optical sensor may be used to determine an approximate tilt or rolling orientation of the head relative to the shoulders.

Furthermore in some embodiments the lack of reflection (or sudden change in distance) may be used to determine when the head has yaw rotated or pitch rotated relative to the torso such that such that earphone optical sensor illumination misses the shoulder.

In some embodiments the optical sensor may generate a dot illumination 603 such as shown by optical sensor 601 or a pattern illumination 613 such as shown by optical sensor 611. The pattern illumination 613 may furthermore be used to more accurately estimate the yaw or pitch rotation. Furthermore by implementing a pair of optical sensors with a pattern illuminations it may be possible to determine whether the rotation is a yaw (each sensor determines a substantially different and opposite change in pattern) or pitch (each sensor determines substantially the same change in pattern).

In some embodiments the optical sensor may be a camera which is configured to capture an image of the shoulder from the viewpoint of the earpiece and by performing image processing determine the approximate differential orientation between the head and the shoulder. The camera may furthermore in some embodiments be mounted on the user device or apparatus held by the user and generate an estimate of the differential head-torso orientation based on analysis of the image comprising the head and the torso. In some embodiments the camera may be used to detect and estimate hand gestures for interaction.

With respect to FIG. 7 a further example of a group of differential headtracking or differential orientation sensors are shown. In an acoustic source, such as an ultrasound transmitter or transducer 705 (which may be mounted or be part of the mobile phone or apparatus) is configured to emit an acoustic wave 707 which may be reflected off the user's shoulder and the reflected wave 709 detected by a microphone 703 located within an earphone or similar. In these embodiments detected signals from both ears can be used to improve the accuracy of the shoulder angle estimation. The acoustic signal may be in ultrasonic or acoustic range.

The signal used can in some embodiments be predefined (maximum length sequence) or the system can utilize the content from the acoustic signal that is the user is listening. For example, as also shown in FIG. 7, the earphone 711 and the output transducer 715 may be designed to emit some of the audio output as a directed acoustic wave 717 which when the head is within a specific range of alignment with the shoulders enables a reflected acoustic wave 719 to be detected by a microphone 713 within the earphone 711.

In some embodiments it is also possible to combine a predefined signal into the content stream. The predefined signal may be one which is psycho-acoustically masked by the content stream or may be outside of the normal human hearing range.

In such embodiments the differential sensor may be tuned to detect the earphone distance from the shoulder—and the features of the reflected sound (e.g. the temporal width and form of the first reflection) may be used to determine whether the shoulder is turned backwards or forwards.

With respect to FIG. 8 a further example of a further group of differential orientation or headtracking sensor implementations is shown. In the example shown in FIG. 8 the earphones 801 are coupled to the torso via a flexible or semi-elastic cable or string. The flexible cable 803*a*, 803*b* may be the wire or coupling 807 between the earphone to a phone. Furthermore the cable 803*a*, 803*b* may be attached or located to the torso with a clip or pin 805. In such embodiments the wire is coupled to a force sensor. For example in FIG. 8 the force sensor comprises a first force sensor 809*a* coupled to a first cable 803*a* and a second force sensor 809*b* coupled to a second cable 803*b*. Any change of relative orientation between the head and the torso causes a change of position, with associated stretching or flexing of the cable. The stretching or flexing may thus be determined by the force sensor and thus generate an estimated relative position of the head and shoulder.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

determining a first absolute orientation value of a head of a user using a head mounted orientation sensor;

determining a second absolute orientation value of a body part of the user using a body located sensor; and controlling a three dimensional (3D) audio reproduction, wherein controlling the 3D audio reproduction comprises spatially processing at least one audio signal based on the first absolute orientation value and the second absolute orientation value, wherein spatially processing at least one audio signal comprises:

determining at least one first filter based on a difference value defined by a difference between the first absolute orientation value and the second absolute orientation value;

determining at least one second filter based on the first absolute orientation value; and combining a first output signal generated as a result of application of the at least one first filter to the at least one audio signal and a second output signal generated as a result of application of the at least one second filter to the at least one audio signal to generate at least one spatially processed audio signal.

2. The method as claimed in claim 1, further comprising determining a first orientation value of the head of the user relative to the body part of the user using the first absolute orientation value and the second absolute orientation value.

3. The method as claimed in claim 2, wherein:

determining the first absolute orientation value of the head of the user using the head mounted orientation sensor comprises determining the first absolute orientation value of the head of the user relative to a reference orientation using the head mounted orientation sensor;

determining the second absolute orientation value of the body part of the user using the body located sensor comprises determining the second absolute orientation value of the body part of the user relative to a further reference orientation using the body located sensor, and determining the first orientation value of the head of the user relative to the body part of the user using the first absolute orientation value and the second absolute orientation value comprises determining the first orientation value of the head of the user relative to the body part of the user using the first absolute orientation value, the second absolute orientation value, the reference orientation and the further reference orientation.

4. The method as claimed in claim 1, wherein each of the first output signal and the second output signal comprises right and left channel output audio signals.

5. The method as claimed in claim 1, wherein the at least one first filter comprises at least one first head related transfer function filter, and wherein the at least one second filter comprises at least one second head related transfer function filter.

6. An apparatus comprising:

processing circuitry; and memory circuitry including computer program code, the memory circuitry and the computer program code configured to, with the processing circuitry, enable the apparatus to:

determine a first absolute orientation value of a head of a user using a head mounted orientation sensor;

determine a second absolute orientation value of a body part of the user using a body located sensor; and control a three dimensional (3D) audio reproduction, wherein controlling the 3D audio reproduction comprises spatially processing at least one audio signal based on the first absolute orientation value and the second absolute orientation value, wherein spatially processing at least one audio signal comprises:

determining at least one first filter based on a difference value defined by a difference between the first absolute orientation value and the second absolute orientation value;

determining at least one second filter based on the first absolute orientation value; and combining a first output signal generated as a result of application of the at least one first filter to the at least one audio signal and a second output signal generated as a result of application of the at least one second filter to the at least one audio signal to generate at least one spatially processed audio signal.

7. The method as claimed in claim 1, wherein controlling the 3D audio reproduction based on the first absolute orientation value and the second absolute orientation value comprises:

implementing a parametric model of the first absolute orientation value of the head of the user relative to the second absolute orientation value of the body part of the user to generate parameters for a pair of head related transfer function filters; and applying the pair of head related transfer function filters to the at least one audio signal to generate the spatially processed at least one audio signal.

8. The method as claimed in claim 1, wherein controlling the 3D audio reproduction based on the first absolute orientation value and the second absolute orientation value comprises at least one of:

controlling playback of the at least one audio signal based on the first absolute orientation value and the second absolute orientation value; and controlling playback of the at least one audio signal based on determining a gesture based on the first absolute orientation value and the second absolute orientation value.

9. The method as claimed in claim 1, wherein controlling the 3D audio reproduction by spatially processing at least one audio signal enables controlling of an output sound scene by moving the body located sensor relative to the head mounted orientation sensor.

10. The method as claimed in claim 1, wherein the at least one audio signal comprises a mid signal and an associated orientation indicator representing a dominant audio source within an audio scene and a side signal representing an ambience within the audio scene.

11. The apparatus as claimed in claim 6, wherein the at least one first filter comprises at least one first head related transfer function filter, and wherein the at least one second filter comprises at least one second head related transfer function filter.

12. The apparatus as claimed in claim 11, further enabled to determine a first orientation value of the head of the user relative to the body part of the user using the first absolute orientation value and the second absolute orientation value.

13. The apparatus as claimed in claim 12, wherein the apparatus is enabled to:

determine the first absolute orientation value of the head of the user using the head mounted orientation sensor by determining the first absolute orientation value of the head of the user relative to a reference orientation using the head mounted orientation sensor;

determine the second absolute orientation value of the body part of the user using the body located sensor by determining the second absolute orientation value of the body part of the user relative to a further reference orientation using the body located sensor, and determine the first orientation value of the head of the user relative to the body part of the user using the first absolute orientation value and the second absolute orientation value by determining the first orientation value of the head of the user relative to the body part of the user using the first absolute orientation value, the second absolute orientation value, the reference orientation and the further reference orientation.

14. The apparatus as claimed in claim 6, wherein the at least one first head related transfer function filter is received from a database comprising a plurality of head related transfer function filters based on the difference value.

15. The apparatus as claimed in claim 6, wherein the at least one second head related transfer function filter is received from a database comprising a plurality of head related transfer function filters based on the first absolute orientation value.

16. The apparatus as claimed in claim 11, wherein the apparatus controls the 3D audio reproduction based on the first absolute orientation value and the second absolute orientation and is further configured to:

implement a parametric model of the first absolute orientation value of the head of the user relative to the second absolute orientation value of the body part of the user to generate parameters for a pair of head related transfer function filters; and apply the pair of head related transfer function filters to the at least one audio signal to generate the spatially processed at least one audio signal.

17. The apparatus as claimed in claim 11, wherein the apparatus controls the 3D audio reproduction based on the first absolute orientation value and the second absolute orientation and is further configured to at least one of:

control playback of the at least one audio signal based on the first absolute orientation value and the second absolute orientation value; and control playback of the at least one audio signal based on determining a gesture based on the first absolute orientation value and the second absolute orientation value.

18. The apparatus as claimed in claim 11, wherein the apparatus controls the 3D audio reproduction by spatially processing at least one audio signal in order to enable control of an output sound scene by moving the body located sensor relative to the head mounted orientation sensor.

19. The method as claimed in claim 5, wherein determining at least one first head related transfer function filter based on the difference value is configured to determine the at least one first head related transfer function filter from a database comprising a plurality of head related transfer function filters based on the difference value.

20. The method as claimed in claim 5, wherein each of the first output signal and the second output signal comprises right and left channel output audio signals, and wherein the at least one first head related transfer function filter and the at least one second head related transfer function filter comprises one pair of head related transfer function filters for generating the right channel output audio signals and another pair of head related transfer function filters for generating the left channel output audio signals.

21. The method as claimed in claim 5, wherein determining at least one second head related transfer function filter is configured to determine the at least one second head related transfer function filter from a database comprising a plurality of head related transfer function filters based on the first absolute orientation value.

22. The apparatus as claimed in claim 6, wherein each of the first output signal and the second output signal comprises right and left channel output audio signals, and wherein the at least one first head related transfer function filter and the at least one second head related transfer function filter comprises one pair of head related transfer function filters for generating the right channel output audio signals and another pair of head related transfer function filters for generating the left channel output audio signals.

* * * * *